US011585220B2

(12) United States Patent
Darlington et al.

(10) Patent No.: US 11,585,220 B2
(45) Date of Patent: Feb. 21, 2023

(54) FRICTION ROCK BOLT

(71) Applicant: SANDVIK INTELLECTUAL PROPERTY AB, Sandviken (SE)

(72) Inventors: Bradley Darlington, Wellard (AU); Peter Young, Queensland (AU); Mietek Rataj, Charlestown (AU)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 147 days.

(21) Appl. No.: 16/611,646

(22) PCT Filed: May 9, 2018

(86) PCT No.: PCT/EP2018/061979
§ 371 (c)(1),
(2) Date: Nov. 7, 2019

(87) PCT Pub. No.: WO2018/206628
PCT Pub. Date: Nov. 15, 2018

(65) Prior Publication Data

US 2020/0063556 A1 Feb. 27, 2020

(30) Foreign Application Priority Data

May 11, 2017 (AU) ..... 2017901751

(51) Int. Cl.
*E21D 21/00* (2006.01)

(52) U.S. Cl.
CPC ..... *E21D 21/004* (2013.01); *E21D 21/0033* (2013.01); *E21D 21/008* (2013.01)

(58) Field of Classification Search
CPC .. E21D 21/0033; E21D 21/004; E21D 21/008
See application file for complete search history.

(56) References Cited

U.S. PATENT DOCUMENTS

| | | | | |
|---|---|---|---|---|
| 4,656,806 | A | 4/1987 | Leibhard et al. | |
| 5,931,606 | A | 8/1999 | Karlsen | |
| 8,714,883 | B2 * | 5/2014 | Rataj | E21D 21/0033 405/259.3 |
| 2012/0251262 | A1 * | 10/2012 | Hidalgo Salgado | F16B 13/066 411/15 |

FOREIGN PATENT DOCUMENTS

| | | | |
|---|---|---|---|
| AU | 2010223134 | B2 | 8/2012 |
| AU | 2012209052 | A1 | 2/2013 |
| AU | 2016101727 | A4 | 11/2016 |
| CL | 60824 | | 11/2017 |
| CL | 201903196 | | 5/2020 |
| GB | 2445675 | A2 | 7/2008 |
| WO | 2008154683 | A1 | 12/2008 |
| WO | 2015189818 | A1 | 12/2015 |

* cited by examiner

*Primary Examiner* — Carib A Oquendo
(74) *Attorney, Agent, or Firm* — Corinne R. Gorski

(57) ABSTRACT

A friction rock bolt assembly is arranged to frictionally engage an internal surface of a bore formed in rock strata. The rock bolt includes an expander mechanism having at least two radially outer wedge elements engageable by an inner wedge element. The expander mechanism is configured for symmetrical displacement of the expander elements to provide controlled enlargement by the rock bolt within the borehole for secure anchorage.

18 Claims, 3 Drawing Sheets

FRICTION ROCK BOLT

RELATED APPLICATION DATA

This application is a § 371 National Stage Application of PCT International Application No. PCT/EP2018/061979 filed May 9, 2018 claiming priority to AU 2017901751 filed May 11, 2017.

FIELD OF INVENTION

The present invention relates to expansion or friction rock bolts suitable for use in the underground mining and tunneling industry for use to stabilise rock strata against fracture or collapse.

BACKGROUND ART

Expansion rock bolts are installed by drilling a bore into a rock strata, inserting the rock bolt into the bore and expanding a part of the bolt to provide a friction lock against the bore surface. Expansion rock bolts include an elongate tube which is expandable radially. This radial expansion is normally facilitated by the tube being split longitudinally and by an expander mechanism being positioned within the tube, normally towards the leading end of the tube (being the end of the tube that is inserted first into the drilled bore in the rock strata or wall). The expander mechanism is connected to a flexible cable or solid bar that extends to the trailing end of the bolt at which point it is anchored such that expansion of the expansion mechanism is effected by pulling or rotating the cable or bar.

The bore that is drilled into the rock strata is intended to be of a smaller diameter than the outside diameter of the tube, so that the tube is inserted as a friction fit within the bore prior to any expansion of the tube. This maximises frictional engagement of the rock bolt via the outside surface of the tube, with the facing surface of the bore. This method of insertion is relatively simple, in contrast with other forms of rock bolts that employ resin or grout to anchor the rock bolt within the bore.

Resin anchored bolts typically comprise a resin cartridge that is required to be inserted into the bore prior to insertion of the bolt. Insertion of the resin cartridge is sometimes very difficult, because typically the tunnel walls extend to a significant height, so that access to bores into which the cartridge is to be inserted can be inconvenient. Additionally, the resin which is employed is relatively expensive and has a limited shelf life.

Cement grouted rock bolts are less expensive than resin anchored bolts, but application of the cement is more cumbersome than that of the resin. Cement grouting requires cement mixing equipment, as well as pumping and delivery equipment, to deliver the mixed cement into the bore.

However, resin or cement anchored rock bolts generally anchor in a bore to provide greater levels of rock reinforcement or stabilisation compared to friction rock bolts, due to a better bond between the bore wall and the resin or cement, compared to the frictional engagement of a friction rock bolt. Also, cement anchored rock bolts typically enable a bond along the full length of the rock bolt and the bore wall.

Any form of rock bolt is susceptible to fail if the bolt is exposed to excessive loading by the rock strata into which the bolt has been installed. Failure can be tensile or shear failure or it can be a combination of tensile and shear failure. In expansion rock bolts, the bolt can fail through fracture of the tube. Failure of that kind can often be tolerated provided the bar or cable of the bolt does not fail also.

A particular type of strata which is difficult to bolt is strata that is either weak or seismic. Upon fracture of this type of strata, the rock bolt can be subject to dynamic loading that tends to cause the bolt to shift outwardly of the bore and to allow the face of the rock mass about the rock bolt to also displace outwardly. Contact with the face of the rock mass about the rock bolt rock bolt is by a rock plate and in certain territories, industry set ground support requirements for seismic conditions such that with ground kinetic energy of 25 kJ, in a diameter of about 1 m about the bore, there should not be a shift in the position of the rock bolt of more than 300 mm. In other words, there should not be an outward displacement of the rock face into the tunnel or underground mine of more than 300 mm. In such conditions resin or cement anchored bolts are not suitable, because the 25 kJ energy creates an impact load on the bolts which exceeds their tensile strength, so that these types of bolts are known to fail in these conditions.

In some existing expansion rock bolts, the energy created by the movement or fracture in the rock strata is transferred straight from the rock plate to the tube of the rock bolt and if the friction engagement between the outside surface of the tube and the facing surface of the bore above the strata fracture is not sufficient, the rock bolt will shift. This is particularly the case in very hard and very weak rock strata because the frictional ability for the rock bolt to properly anchor in that strata is poor.

For example, in some existing expansion rock bolts, the rock bolt expands engagement members (wedges for example) outwardly to gouge into the bore wall to improve the anchor of the bolt in the strata. While the initial gouging might be minor, any movement of the rock bolt outwardly of the bore under load will cause the members to gouge further into the bore wall and to resist further outward movement. However, in very hard strata, the members cannot gouge into the bore wall, or can do so only at a minimal level and so the contact between the rock bolt and the bore wall is largely frictional engagement only.

In contrast, in very weak rock, the bore in which the rock bolt is installed is often "over drilled", i.e. is of a greater diameter than desired so that the expansion members cannot expand sufficiently to gouge into the bore wall to the depth needed to properly engage the bore wall. A rock bolt that addresses one or more of the disadvantages of prior art rock bolts would be desirable.

SUMMARY OF THE INVENTION

It is an objective to the present invention to provide a friction rock bolt and a rock bolt assembly that may be conveniently driven into a borehole formed within rock strata and is capable of being clamped in position via a robust and reliable clamping force resistant to ground kinetic energy loads and impact loads that would otherwise encourage dislodgement of the rock bolt from the bore.

It is a specific objective to provide a rock bolt having a clamping mechanism configured to apply a radial expansion force within the as-formed bore at or towards a leading end of the rock bolt so as to maximise the frictional contact force with which the rock bolt is secured within the bore.

It is a further specific objective to provide a rock bolt configured to resist and to withstand ground kinetic energy and impact load at the rock bolt due to strata shifts. It is a specific objective to provide a rock bolt configured to maintain a fully anchored position within a bore in response to ground kinetic energy of the order of 25 kJ and impact loading on the rock bolt of the region of 45 t.

The objectives are achieved via a rock bolt (rock bolt assembly) having an expander mechanism to provide a symmetrical and controlled expansion at the axially forward end of the rock bolt. The objectives are further achieved by providing an expander mechanism and a rock bolt arrangement in which the tubular sleeve that at least initially houses the expander mechanism is configured to facilitate the symmetrical expansion in combination with a plurality of radially outer wedging elements that function cooperatively with the specifically configured tubular sleeve to provide the controlled expansion at the axially forward end.

Additionally, the objectives are achieved via a loading mechanism provided at an axially rearward end of the rock bolt having a load/shock absorbing configuration to withstand impact loading forces transmitted to the rock bolt from the strata. The loading mechanism comprises a specific load absorber configured to deform, optionally via compression, crushing, crumpling, fracturing, deforming, failing or at least partially failing in response to a predefined/predetermined loading force (such as an impact loading force). Such an arrangement provides an initial stage load absorption. The present rock bolt arrangement is further provided with a main load bearing element into which the high loading forces are transmitted during/following initial absorption by the load absorber. Accordingly, in one aspect the present rock bolt comprises a multi-stage load and shock absorbing configuration to effectively distribute loading forces across multiple component part/features of the rock bolt assembly. Accordingly, a rock bolt arrangement is provided to better withstand ground kinetic energy loading and in particular impact loading due to elevated and/or sudden strata movement.

According to a first aspect of the present invention there is provided a friction bolt assembly to frictionally engage an internal surface of a bore formed in rock strata, the assembly comprising: an elongate tube having a leading end, a trailing end and a longitudinally extending primary slot; an expander mechanism located within the tube towards or at the leading end and configured to apply a radial expansion force to the tube to secure the assembly to the rock strata; an elongate tendon extending longitudinally within the tube and connected at or towards a first end to the expander mechanism and at or towards a second end to a loading mechanism positioned at or towards the trailing end of the tube that by adjustment is configured to create tension in the tendon to act on the expander mechanism and provide the radial expansion force; characterised in that: the expander mechanism comprises: at least two radially outer wedge elements positionally secured to the tube; and a radially inner wedge element secured to the tendon and capable of axial movement relative to the outer wedge elements to apply the radial expansion force to the outer wedge elements; the elongate tube further comprising at least one secondary slot positioned axially at the expander mechanism such that the tube is capable of deforming radially at the axial position of the expander mechanism via the primary and secondary slots in response to axial movement of the inner wedge element and the expansion force transmitted by the outer wedge elements.

Optionally, the outer wedge elements each comprise a radially inward facing surface that is oblique relative to a longitudinal axis extending through the assembly and a radially outward facing surface of the inner wedge element extends oblique relative to the longitudinal axis. Preferably, the inner wedge element comprises a radial thickness that is tapered along its respective length so as to comprise a radially thinker forward end and a radially thinner rearward end. Similarly, the outer wedge elements comprise a radial thickness that is tapered along the respective lengths so as to comprise a radially thinker rearward end and a radially thinner forward end.

Optionally, the radially inward facing surface of the outer wedge elements and/or the radially outward facing surface of the inner wedge element are at least part conical or frusto-conical. The respective surfaces accordingly may be concave in a plane perpendicular to the longitudinal axis of the rock bolt. Optionally, the radially inward facing surfaces of the outer wedge elements and/or the radially outward facing surface of the inner wedge element are at least chisel shaped, part-chisel shaped or wedge shaped having tapering surfaces (in the longitudinal direction) that are generally planar.

The relative alignment of the frictional engagement surfaces between the inner and outer wedging elements being oblique i.e. transverse, angled or alternatively inclined relative to the longitudinal axis of the rock bolt, contributes to maintaining the outer wedges in a symmetrical configuration as the inner wedge element forces radial expansion and distortion of the tube.

Preferably, the secondary slot is positioned diametrically opposed to the primary slot. Where the present assembly comprises a plurality of secondary slots, preferably the secondary slots are evenly spaced apart in a circumferential direction around the longitudinal axis with the outer wedging elements positioned between each respective slot. Positioning the secondary slot diametrically opposite the primary slot specifically provides symmetric expansion of the expander mechanism and maintains the outer wedge elements in spaced apart orientation.

Preferably, an axial length of the secondary slot is less than an axial length of the primary slot. Optionally, the axial length of the secondary slot is 0.1 to 50%, 0.5 to 40%, 0.4 to 30% or 2 to 25% of a total axial length of the elongate tube. The secondary slot extends axially a short distance beyond the expander mechanism (inner and outer wedge elements) in both the axial forward and rearward directions. The primary function of the secondary slot is to facilitate expansion of the expander mechanism and to maintain the circumferential spacing of the outer wedge elements. Accordingly, the secondary slot is not required to extend the full length of the tube and accordingly the tube strength is optimised to provide sufficient strength during initial installation of the rock bolt into the borehole via hammering. Preferably, the secondary slot comprises a width being less than a width of the primary slot.

Preferably, the outer wedge elements are spaced apart in a circumferential direction by an equal separation distance. This configuration facilitates symmetrical expansion of the expander mechanism and ensures the frictional sliding surfaces of the inner and outer wedge elements are appropriately aligned relative to one another to avoid sideways (torsional) forces and galling.

Preferably, in a circumferential direction, the outer wedge elements are positioned between and do not overlap with the primary and secondary slots. It is important the outer wedging elements do not hinder expansion of the tube by restricting deformation of the tube at the region of the slots. As indicated, the significant advantage with the present concept is the extent and control of the radial expansion that is achievable via a symmetrical sliding engagement between the inner and outer wedge elements.

Preferably, the outer wedge elements are secured to a radially inward facing surface of the tube by welding. More preferably, the outer wedge elements are secured to the tube exclusively at or towards an axially rearward end (or face) of each of the wedge elements. This attachment mechanism is sufficient to maintain the outer wedge elements in fixed position relative to the inner wedge and tube but does not provide an overly rigid structure that would be resistant to radial expansion. Accordingly, some degree of movement of the outer wedge elements is provided which is beneficial for controlled radial expansion.

Optionally, at least a portion of each of the outer wedge elements extends axially beyond the leading end of the tube. Optionally, at least a portion of the radially inner wedge element extends axially beyond the leading end of the tube. Optionally, a maximum outside diameter of the inner wedge element is greater than an inside diameter of the tube. Optionally, a maximum outside diameter of the inner wedge element is approximately equal to an inside or outside diameter of the tube. Such dimensional relationships may apply to the tube pre-installed within a bore hole (in the rock strata) of post installation within the bore hole (with the latter involving radial compression of the tube). Accordingly, it is possible to provide an inner wedge element having a greater maximum diameter relative to conventional arrangements so as to strengthen the inner wedge element against stress imparted by the elongate bar and contact with the outer wedge elements. Accordingly, the inner wedge element is less susceptible to cracking during use. Additionally, due to the enlarged dimensions of the radially inner wedge element, not being restricted by the internal diameter of the tube, a greater radial expansion is achievable.

Optionally, the tendon is an elongate bar that is radially enlarged at or towards the first end. Preferably, the first end of the bar comprise threads, with the threads provided at the radially enlarged first end. Preferably, the inner wedge element is mounted on the bar via the threads. Optionally, the second end of the bar may be radially enlarged and comprise treads. The radial enlargement reinforces the bar against tensile stress and mitigates the creation of stress concentrations due to the presence of the threads formed at the external surface of the bar.

Preferably, the assembly comprises a single primary slot, a single secondary slot and two outer wedge elements positioned diametrically opposite one another and spaced apart in a circumferential direction between the primary and secondary slots. Such a configuration provides an expander mechanism that may be manufactured and assembled conveniently in addition to providing an effective means for anchoring the rock bolt within the bore by maximising the extent and reliability of the radial expansion.

Optionally, the assembly may further comprise a loading mechanism projecting radially outward at the trailing end of the tube so as to be capable of being braced against the rock strata at a region around an external end of the bore; a main load element connected with the tendon at the second end to brace against the trailing end of the tube and by adjustment create tension in the tendon to act on the expander mechanism and provide the radial expansion force; the loading mechanism further comprising a load absorber to absorb load imposed on the loading mechanism by the rock strata and in response to deform or fail to transfer said load to the main load element.

The provision of a multi-stage load support arrangement advantageously allows a load that is applied to a rock bolt to be absorbed in separate stages so that individual components and stages are required to absorb the full load. This is important as it means that the full load is not immediately transferred to the tendon or the tube of the rock bolt. Rather, the load is first reacted or partially absorbed by the load absorber (or first support element) and if the load is above a predetermined failure load, the load absorber deforms or at least partially fails and the remaining load is then reacted or absorbed by the main load element (or second support element). Advantageously, the load absorber will absorb some of the load or the energy, so that the load that is applied to the main load element is lower than it would have been had the full load been applied directly to the main load element. The energy of the rock displacement is thus dissipated as the load absorber initially absorbs the load and then deforms or partially fails. The remaining energy is then absorbed by the main load element, because the load applied to the main load element is lower than the tensile strength of the tendon. The load is reacted by the tendon by the tendon applying a pull load on the expander mechanism tending to expand the expander mechanism. The resistance to expansion provides the required reaction.

As an example, the bars typically used for ground support have a tensile strength of up to 33 t. Also, the load absorber could be arranged to deform or partially fail at 10 t. Where a load is applied where ground kinetic energy is in the order of 25 kJ, the impact load on the rock bolt could be in the region of 45 t. For this, the load absorber will deform or partially fail at about 10 t and thus will absorb the first 10 t of the load. The actual act of rock displacement when the load absorber deforms or partially fails also absorbs displacement load or energy (and so diminishes the ground kinetic energy) and so at the point at which the load absorber deforms or partially fails, some energy is absorbed via the movement in the rock strata itself and via the action of the load absorber deforming or partially failing. In fact, the rock displacement can cause some, most or all components of the loading mechanism to deform slightly and the expander mechanism to expand (upon movement of the tendon) which can each provide for some additional energy absorption, although these latter two forms of absorption do not always occur and so are not reliable in a rock displacement as absorption mechanisms.

Following energy absorption by the load absorber and associated mechanisms (rock displacement, bearing arrangement deformation etc.) the bar of the rock bolt would then absorb the remainder of the energy, of which the impact load would now be below the tensile strength of the bar and so the bar would not fail and thus the rock bolt would not fail.

Optionally, the load absorber may comprise a compressible collar positioned in contact with the main load element. Optionally, the load absorber may comprise a curved or bent region of a flange, plate or washer, the region extending in a direction axially towards the main load element.

In certain embodiments, the tube is slotted longitudinally, along at least a portion of its length, but preferably fully along its length, to facilitate radial expansion and contraction of the tube. Radial contraction is required so that the tube can be driven into a bore which has an internal diameter which is slightly less than the external diameter of the tube. This advantageously permits the rock bolt to be inserted into firm frictional engagement with the internal wall of the bore. The external surface of the tube thus engages the bore wall frictionally upon insertion and prior to any expansion of the expander mechanism. Expansion of the expander mechanism and radial expansion of the tube is greatly facilitated by the provision of the secondary slot or slots that extend axially along the tube at the axial position of the expander mechanism. The action of the expander mechanism is principally to increase the frictional engagement between the rock bolt and the internal surface of the bore. In soft or weak rock, the expansion force of the expander mechanism might exceed the compressive strength of the rock, so that radial expansion of the tube could be quite significant. Also, the action of the expander mechanism is to resist radial contraction of the tube when subject to an external load applied by the rock strata. In addition, where the bore diameter has been over-drilled, the tube can be radially expanded to properly engage the bore wall.

Optionally, the tube may have a tapered leading end to assist insertion into a bore or it can be of generally constant diameter along its length. Where the tube has a tapered leading end, the tapered section can include a slot that opens through the leading edge of the tube. This allows the leading end to compress radially as the rock bolt is inserted into the bore. Two axial end slots that are diametrically opposed are the preferred arrangement.

Optionally, the tendon can be a rigid tendon, such as a metal bar, rod or rigid cable, a cable which is not rigid, or it can be a hollow bar.

The present rock bolt is adapted for use with a conventional rock plate that connects to one end of the rock bolt and that extends into contact with the face of the rock strata about the bore. The present rock bolt may comprise any suitable form of rock plate found in the art.

The expander mechanism may comprise a first pair of expander elements that are secured to the tube diametrically opposite each other. These can be fixed in place in any suitable manner relative to the tube, but normally would be fixed by welding. The welding may be applied to the tube and in particular a short slit formed in the tube that is filled with weld and/or the weld could be applied to the inward facing surface of the tube. The expander may alternatively include three expander elements that are spaced apart substantially equally in the circumferential direction and are secured relative to the tube, or four or more expander elements, that are generally all spaced apart substantially equally in the circumferential direction.

The expander elements can have any suitable shape such as tapered or wedge shape. The shape of the expander elements will normally be identical to each other and when positioned with the tube, they will be symmetrical about the axis of the tube. However, the invention does not preclude that the expander elements are shaped differently to each other or that they are not symmetrical about the axis of the tube.

In some forms, the radially outer wedge elements and the radially inner wedge elements that form the expander mechanism are configured such that movement of the engagement structure in a first axial direction allows the expander elements to move towards each other and thus to allow radial contraction of the tube, while movement of the engagement structure in a second and opposite axial direction causes the expander elements to move away from each other and thus to provide radial expansion of the tube. To promote this form of radial contraction and expansion of the tube, the expander elements and the engagement structure can form a wedge whereby the engagement structure engages diametrically opposed surfaces of the respective expander elements. The engaging surfaces can be surfaces of a constant incline. The engaging surfaces can be flat or planar surfaces (such as those formed on a cone), or they can be curved mating surfaces, such as mating concave and convex surfaces (such as those formed on an ogive.

The radially inner wedge element may have any suitable form. In one form, the inner wedge element has a conical form with flat or planar surfaces for tapered engagement with the expander elements. Optionally, the radially inner wedge element may have a central opening to accept the tendon and the opening can be threaded to threadably connect to the tendon. The radially inner wedge element can be otherwise connected to the tendon as appropriate. The radially inner wedge element could alternatively comprise a second pair of expander elements that are connected to the tendon and that are separate to each other but are both connected to the tendon. The second pair of expander elements can be connected to each other or can be part of a larger structure that is connected to the tendon.

Within a wedge-type expander mechanism as described herein, the wedge angle governs the length of the cooperating wedge elements, i.e., the shallower the wedge incline or taper, the longer the elements need to be for a given amount of expansion. For greater expansion, at a set wedge incline or taper, the cooperating wedge elements need to be longer. However, long wedge elements are more expensive because they require more material, a longer threaded bore for connection to the tendon and the thread applied to the tendon also needs to be longer. In addition, the threads applied to the components are hot deep galvanised and need to be specially cleaned and so longer threads require more galvanising material and take longer to clean.

In the development of the prior art rock bolt of Australian Patent Application 2010223134, it was found to be important that the angle of the wedge engagement was relatively shallow for the most efficient expansion to be gained using an installation machine torque of 400 Nm. In Australian Patent Application 2010223134, a single expander element cooperating with a single expander at a 5° inclusive angle between the expander element fixed to the tube and the expander fixed the tendon was selected for the optimum expansion force and length of engagement between the expander elements and the engagement structure.

In the present invention however, the initial expansion of the expander mechanism is not critical, as the expander mechanism can expand further after the rock bolt has been installed. This means that the angle of engagement between the cooperating wedge elements is not as important and so the inclusive angle between the cooperating wedge elements can be increased, and estimates are that it can be increased to 10, 12, 14, 16 or 18, 20° inclusive with the preferred angle being around 16°. Because of this, the length of the expander elements can be reduced or will not be excessive.

In the prior art of Australian Patent Application 2010223134, a further restriction is that the element attached to the tendon needed to have its threaded bore as close to the non-tapered side of the element as possible but still leaving about a 4 mm wall thickness at the non-tapered side for the structural integrity of the element. This 4 mm wall thickness requirement limits the maximum expansion as compared to the bore being closer to the un-tapered side than 4 mm. In the present invention, the bore can be central of the engagement structure and so full tapering can be provided. The above advantages mean that present invention allows the tube expansion of the rock bolt to be increased by about 2, 4, 6 or 8 mm, with 4 mm being preferred, which is significant and which was not apparent until the second aspect was developed.

To facilitate tube expansion in the region of the expander mechanism, the tube includes a secondary longitudinal expansion slot or slit which extends axially along the tube for an axial section corresponding to the location of the expander mechanism. Preferably, the secondary expansion slot or slit is positioned diametrically opposite the tube primary longitudinal slot that extends fully (or over a majority) of the tube length (between repetitive ends). The length of the secondary expansion slot is preferably much less than the primary longitudinal slot and may be in region of about 200 mm long.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
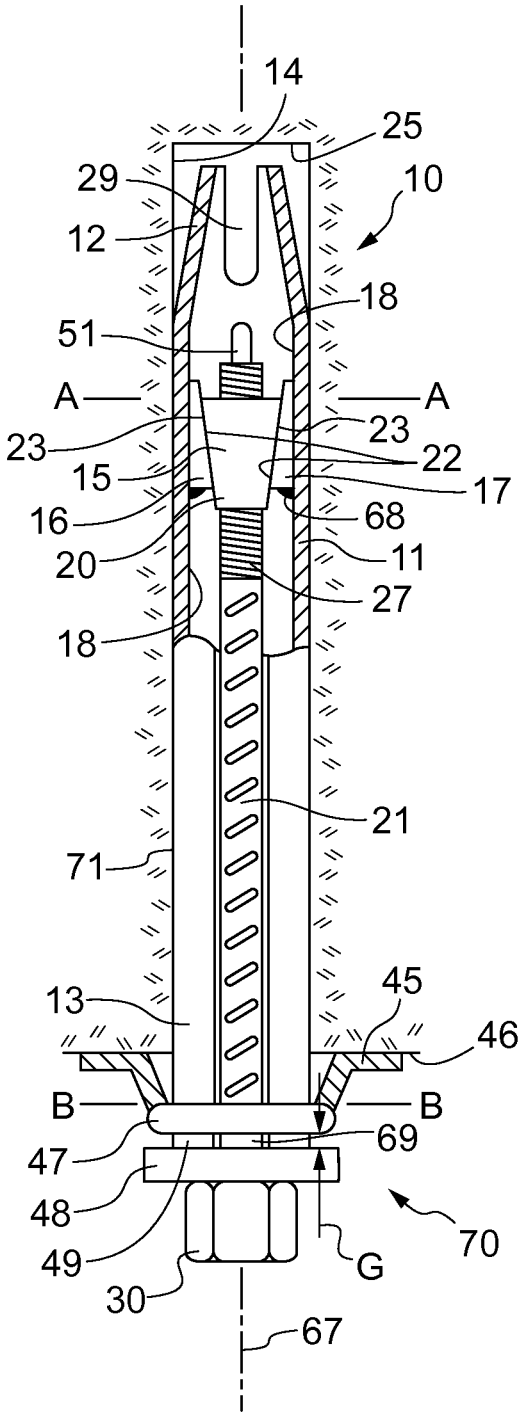
FIG. 1 is a cross-sectional view of a friction rock bolt according to an aspect of the present invention.

FIG. 1 is a cross-sectional view of a friction rock bolt 10 according to one embodiment of the invention. The rock bolt 10 includes an elongate generally cylindrical tube 11 (having a circular cross section) with a leading end 12 and a trailing end 13. The length of a typical rock bolt be can in the range of about 1 m to about 5 m.

The tube 11 is split longitudinally along its full length via a primary slot 26 so that it can be expanded radially for improved frictional engagement with the inside surface 14 of a bore which is drilled into a body of rock or a rock strata.

Figure 2:
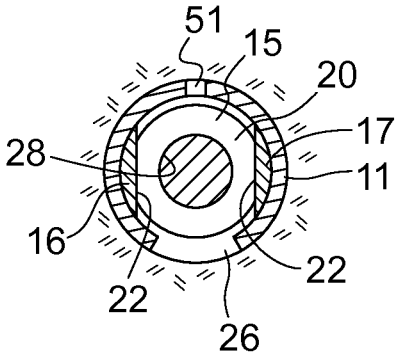
FIG. 2 is a cross-sectional view through AA of FIG. 1.

For the purpose of expanding the tube 11 radially, or to increase the frictional contact between the outer surface of the tube 11 and the surface 14 of the bore with or without radial expansion, the rock bolt 10 includes an expander mechanism 15 within the tube 11 and disposed at or towards the leading end 12 of the tube 11. The expander mechanism 15 includes a pair of first wedge like expander elements 16 and 17 that are secured to the inside surface 18 of the tube 11. FIG. 2 also shows this arrangement and in that figure, it is clear that the expander elements 16 and 17 are secured to the inside surface 18 of the tube in positions that are diametrically opposite each other.

The expander mechanism 15 further includes an engagement structure 20 in the form of a radially inner wedge element that is secured to a tendon on the form of an elongate bar 21 (which could alternatively be a cable), and is positioned at the leading end of the bar 21 and for cooperation or engagement with the respective radially outer expander (wedge) elements 16 and 17.

It can be seen from FIG. 1, each of the generally wedge-shaped expander elements 16, 17 comprise a radially inward facing surface 22 that is aligned oblique to a longitudinal axis 67 of the rock bolt 10 so as to be generally tapered. Similarly, the radially inner wedge element 20 comprises a radially outward facing surface 23 that is also aligned oblique to longitudinal axis 67 and parallel to outward facing surface 22 of the outer wedge elements 16, 17. Such an arrangement enables the inner wedge element 20 to slide in frictional contact with outer wedge elements 16, 17 as the elongate bar 21 is actuated and the inner wedge element 20 moved axially relative to the stationary outer wedge elements 16, 17. The complementary aligned surfaces 22, 23 are advantageous to facilitate maximum symmetrical expansion of the expander mechanism 15 and avoid galling of regions of the surfaces 22, 23. In particular, it will be evident from FIG. 1, that as the inner wedge element 20 moves in a direction away from the blind end 25 of the bore, the relative movement and engagement that occurs between the outer elements 16 and 17 and the inner element 20 will tend to cause the tube 11 to expand radially and force the tube 11 into greater frictional contact with the surface 14 of the bore. That radial expansion is facilitated by slot 26 (formed longitudinally of the tube 11 as shown in FIG. 2).

Expander elements 16 and 17 may be secured against the inside surface 18 of the tube 11 in any suitable manner and preferably are secured by weld 68. Likewise, the inner element 20 can be secured to the bar 21 in any suitable manner. In FIG. 1, the leading end 27 of the bar 21 is threaded to threadably engage a threaded bore 28 formed in element 20.

The leading end 12 of the tube 11 is tapered to facilitate insertion of the rock bolt 10 into a bore drilled into a rock strata. FIG. 1 shows a slot or slit 29 formed in the leading end 12 to allow the leading end 12 to compress radially if necessary for insertion into the bore. In practice, there could be two slots 29 formed diametrically opposite each other for this purpose, or three slots at 120° to each other, or four slots at 90° etc.

The expander mechanism 15 is shown in FIG. 1 in an actuated or activated state, in which the inner wedge element 20 has been shifted relative to the outer wedges 16 and 17 to cause an expansion load to be applied to the tube 11. However, when the rock bolt 10 is to be inserted into the bore, the inner wedge element 20 would be in a position in which it would be further towards the leading end 12 of the tube 11. The intention would be that wedge element 20 would be positioned so that the expander mechanism 15 is not imposing an expansion load on the tube 11. Indeed, it is preferred that inner wedge element 20 be positioned such that the tube 11 can radially compress or contract as the bolt 10 is inserted into a bore by the bore being drilled to a diameter which is slightly smaller than the outside diameter of the main portion of the tube 11. This naturally allows the tube 11 to compress or contract radially as the bolt 10 is forced into the bore and thus allows the outside surface of the tube 11 to frictionally engage the inside surface 14 of the bore so that once the rock bolt 10 is fully inserted into the bore, there will already be a frictional engagement between the tube and the inside surface of the bore.

Once the bolt 10 has been fully inserted into the bore, the expander mechanism 15 can be activated, to impose a radial expansion load on the tube 11 and so to increase the frictional engagement between the tube 11 and the inside surface 14 of the bore. As indicated, activation of the expansion mechanism 15 causes wedge element 20 to shift (relative to the stationary elements 16 and 17) in a direction away from the blind end 25 of the bore. This movement may be achieved either by pulling the bar 21 in a direction away from the blind end 25, or by rotating the bar 21 so that by the threaded engagement between wedge element 20 and the bar 21, wedge element 20 is drawn in a direction away from the blind end 25. Rock bolt 10 comprises a nut 30 located at a trailing end 69 of bar 21 to represent a head of the bar 21 and to be configured to brace against the trailing end of tube 11 either directly or indirectly via an axially intermediate washer 48. Nut 30 may be formed integrally (i.e., fixed) at the end 69 of the bar 21. Alternatively, nut 30 may be threadably connected to the end 69 of the bar 21. In that latter arrangement, inner wedge element 20 would shift relative to the elements 16 and 17 with movement of the bar 21 as opposed to the arrangement where the bar 21 rotates and the inner wedge element 20 shifts relative to the bar due to the threaded engagement between the bar 21 and wedge element 20.

In another alternative, the nut can be a blind nut with an internally threaded bore, so that the nut 30 can be threaded onto the threaded free end of the bar 21 to the point at which the blind end of the threaded opening engages the end of the bar, at which point no further threaded movement can take place. Further rotation of the nut then will cause rotation of the bar 21.

The expander mechanism 15, comprising a pair of expander elements 16 and 17 contrasts with earlier arrangements in which only a single wedge element is provided at the tube internal surface. In those arrangements, a wedge element that has been fixed to the bar or cable interacts with the single wedge element that is fixed to the tube, but the expansion available in the arrangements employing a single wedge element is less than that available in the arrangement of the present invention. Thus, by the provision of a pair of expander elements 16 and 17, which are in diametrically opposed positions against the inside surface of the tube 11, there can be an increased level of expansion of the tube 11. In prior art arrangements, the maximum expansion of a tube is in the region of 52 mm, whereas in the new arrangement illustrated in FIG. 1, the expansion can be up to 56 mm. While this increase is only relatively small, the benefits it provides can be significant. For example, in very weak rock where the bore diameter is over drilled, the maximum expansion of prior art bolts might not be sufficient to frictionally engage the bore surface with sufficient force to properly fix the bolt within the bore. However, the extra expansion facilitated in a rock bolt according to the present invention enables greater expansion and thus means it is more likely that a rock bolt expanded in weak rock will be able to sufficiently engage the bore surface to properly anchor the bolt within the bore.

The arrangement of the expander elements 16 and 17 as being diametrically opposed within the tube 11 is further advantageous to ensure that there is no misalignment between the elements 16 and 17 as the expander mechanism is initially activated and under subsequent loading through failure or movement in the rock strata. Where misalignment occurs this can develop torsional loading that could negatively affect the weld connection of the elements 16 and 17 to the inside surface 18 of the tube 11. Moreover, misalignment between the elements 16 and 17 and the structure 20 can result in reduced surface engagement between the respective components which could affect the proper expansion of the expander mechanism 15.

To improve the likelihood of complete alignment between the inner and outer elements 20, 16, 17, a secondary (further) slot or slit 51 is provided opposite the primary tube slot 26 to facilitate symmetric tube expansion as the expander mechanism 15 expands as shown in FIGS. 1 and 2. As illustrated in FIGS. 1 and 2, secondary slot 51 comprises different dimensions to primary slot 26 and for example, includes a width and a length that are less than those of primary slot 26. In particular, slot 51 may comprises a width of about 5 mm and a length of about 200 mm. Such a further slot or slit 51 can also be provided in the FIG. 3 arrangement.

Figure 3:
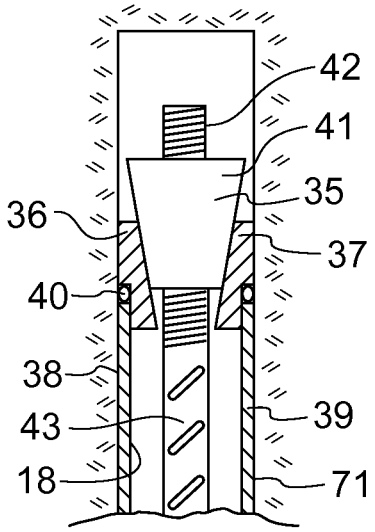
FIG. 3 is a cross-sectional view of the leading end of a friction rock bolt according to another aspect of the present invention.

With reference to FIG. 3, an alternative expander mechanism 35 is illustrated which includes a pair of outer wedge elements 36 and 37 that are welded to the free end 38 of the rock bolt tube 39. The elements 36 and 37 are welded via the annular weld 40 to the free end 38 of the tube 39 and therefore the elements 36 and 37 are not only present within the tube 39, but extend out of the tube 39. An engagement structure (inner wedge element) 41 is threadably attached to the threaded end 42 of the bar 43 and relative movement of the inner wedge element 41 relative to the outer (stationary) elements 36 and 37 can be as described in relation to the embodiment of FIGS. 1 and 2 (referring to elements 20, 16 and 17. The arrangement of FIG. 3 facilitates even greater expansion of the tube 39 compared to the tube 11 of FIGS. 1 and 2 because the diameter of the inner wedge element 35 can be greater than the diameter of the wedge 20 of the FIG. 1 embodiment. In particular, inner wedge element 35 is generally frusto-conical along some, most or all of its axial length (consistent with the FIG. 1 embodiment). The inner wedge element 35 may comprise a maximum diameter (at its thickest axial leading end) that is greater than an insider diameter of tube 11 (as defined by tube internal facing surface 18) with the tube compressed and squeezed into the as-formed bore hole 14, in contact with bore surface 14. Moreover, the maximum diameter of inner wedge element 35 is approximately equal to an outside diameter of tube 11 (as defined by tube external surface 71). Such an arrangement is beneficial to strengthen the inner wedge element 35 against compressive stress encounter during use and imparted by bar 21. Additionally, the arrangement of FIG. 3 is expected to gain a further 5 to 6 mm of tube expansion. Slots (not shown) are provided in the tube 39 to extend through the free end 38 facilitate that expansion and are to be considered consistent with the secondary slot 51 of the embodiment of FIGS. 1 and 2.

In other respects, the arrangement of FIG. 3 is the same as FIG. 1, except that it will be apparent that the leading end of the tube 39 is not tapered in the manner shown in FIG. 1 as the tube 39 is required to remain of constant diameter to facilitate attachment of the elements 36 and 37 to the free end 38 of the tube 39.

Figure 2A:
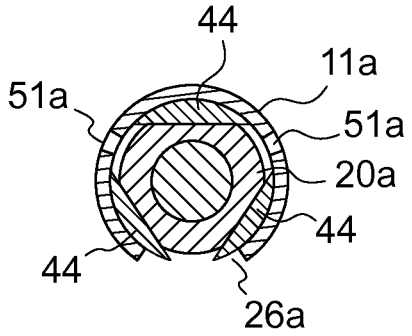
FIG. 2A is a modified version of FIG. 2 showing an alternative expander mechanism.

While the figures show a pair of expander elements 16, 17 and 36, 37, the invention covers arrangements in which an arrangement of three expander elements is provided, or there could more expander elements. These expander elements can be wedge elements of the kind shown in the figures and they can all be fixed to the tube by welding. One or two of the expander elements can be welded in such a position that it or they would extend into or over, or even to substantially cover the longitudinal slot (longitudinal slot 26 as shown in the figures) of the tube. FIG. 2A illustrates a tube 11*a* having a primary longitudinal slot 26*a* and a pair of secondary slots 51*a*. An engagement structure (inner wedge element) 20*a* cooperates with three outer wedge elements 44, two of which extend into or at least partially over the longitudinal slot 26*a*. The slots 51*a* have the same purpose as the slot 51 described earlier, however because there are three expander elements 44, two slots 51*a* are required.

The arrangement as illustrated in FIG. 2A can advantageously act to prevent the engagement structure attached to the tendon from being dislodged out of the tube by significant impact loading, such as might happen during insertion of the rock bolt into a bore. For example, the rock bolt can be subject to significant impact loading during manoeuvring of the installation machine where the leading end of the bolt might strike the rock surface with a relatively large lateral force. By placing the expander elements in such a position that they extend into or over the longitudinal slot, the engagement structure is less likely to, or will actually be prevented from egress out of the tube during a significant impact event.

Figure 4:
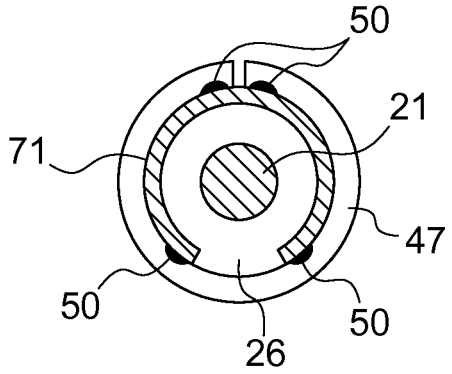
FIG. 4 is a cross-sectional view through BB of FIG. 1.

Returning to FIG. 1, at the trailing end 13 of the tube 11, a rock plate 45 is shown bearing against the rock face 46. The plate 45 as illustrated is not reflective of the shape of plate that would actually be used in the field, but it is sufficient for the purposes of this description. The plate 45 bears against the rock face 46 and against a ring 47 which is welded to the outside surface of the tube 11. A plate or washer 48 is positioned axially between nut 30 and an axially rearwardmost free end 49 of tube 11. Importantly, a gap G is provided between ring 47 and washer 48. FIG. 4 is a cross-section through B-B of FIG. 1 and shows spot welds 50 for securing ring 47 to an external surface 11*a* of tube 11. In particular, four spot welds 50 are provided.

The arrangement described above at the trailing end 13 of the tube 11 is a loading mechanism 70 (alternatively termed a support arrangement) for supporting loading that is imposed on the rock bolt 10 by movement or failure in the rock strata and in particular, provides a multi-stage load support. In a first stage, load support is provided by ring 47, whilst in a second stage, rock support is provided by the washer 48 and the nut 30. The operation of the multi-stage loading mechanism 70 is as follows. With the rock bolt 10 inserted within a bore and the expansion mechanism 15 expanded, if a load is applied to the rock bolt (normally a dynamic load), then the first stage of support is provided by loading mechanism 70 between the rock plate 45 and the ring 47. In the event that the load which is applied to the rock bolt exceeds the shear strength of the spot welds 50, then those welds will fail and the ring 47 will shift to take up the gap G and to bear against the washer 48. The first stage of load support thus is provided up to the point at which the spot welds 50 fail. Upon failure of the spot welds 50, the load which is applied to the rock bolt 10 will shift to the washer 48 and the nut 30, so that the load will be reacted by the bar 21 to which the washer 48 and the nut 30 are connected. That load will tend to shift the bar away from the blind end 25 of the bore and thus will cause a shift of inner wedge element 20 relative to the outer elements 16 and 17 of expander mechanism 15. This will have the effect that there will be a greater expansion load applied by the expander mechanism 15 to even more firmly force the tube 11 into frictional engagement with the inside surface 14 of the bore and by that increased frictional engagement, the load applied to the rock bolt 10 will be supported up to the point at which the bar 21 itself fails. In addition, the tube 11 will be prevented from movement relative to the surface 14 of the bore (other than very minor movement) by the increased frictional engagement between the tube 11 and the bore wall as the expander mechanism 15 operates to increase the frictional engagement load. The rock bolt 10 is thus restrained against movement within the rock strata, or is restrained with acceptable levels of movement.

As explained above, the increased expansion available with the expander mechanisms 15 and 35 facilitates improved load support where loads of the above described kinds occur in weak rock. Thus in weak rock, if a dynamic load occurred of a magnitude that caused the spot welds 50 to shear, there is an improved likelihood of the rock bolt absorbing the dynamic load where the ability of the rock bolt to expand radially is greater.

The multi-stage (two stage) load support arrangement discussed above is important and advantageous for the following reasons. When a rock bolt is subject to a significant initial load, such as in seismic rock conditions, the sudden dynamic loading can be greater than the tensile strength of the bar or cable which would typically be expected to absorb the load. For example, when the rock kinetic energy is at a level of about 25 kJ, the impact load may exceed 45 t. However, the tensile strength of bars typically used in rock bolts is not more than 33 t so in such conditions, the bar would break. This obviously could compromise the support role that the rock bolt is intended to have. However, by providing a multi-stage load support arrangement, the initial load can be partly absorbed by the ring 47 up to the point of shear which would occur in the region of 2-10 t. Some of the initial load energy is thus absorbed by the ring up to the point of shearing and thereafter, the load energy is transferred via the washer 48 and nut 30 to the bar 21. By absorbing 2-10 t of the overall load energy initially, the energy which is transferred to the washer and nut is significantly reduced and is then likely to be of a magnitude which will develop a tensile load that is less than the tensile strength of the bar. In the illustrated embodiment, the gap G is important, because it allows the spot welds 50 to shear. If the gap G was not provided, and the ring 47 rested against the washer 48, there would be no first stage of load absorption. The gap G between the ring 47 and the washer 48 is optimally between 5-8 mm. According to some installations procedures this allows for some 'mushrooming' of the trailing end of the tube during impact (hammering) installation, which typically is about 2 mm, but does not leave the gap G too large to allow excessive rock displacement as the ring 47 shears. A rock bolt according to the figures is thus expected to provide greater reliability of rock support, particularly in seismic rock conditions or in weak rock.

The multi-stage load support arrangement of FIG. 1 represents just one form of arrangement which provides the support required. In alternative arrangements, multiple load absorbers (optionally in the form of rings 47) could be provided at the rearward tube end 13 to provide further stages of load support or energy absorption. Each of the multiple load absorbers (e.g., rings 47) could be spaced apart sufficient to allow successive energy absorption (e.g., by a shear of the welds 50). The minimum number of load absorbers is one and may comprises one or two rings, while any number of rings beyond two could be provided as required.

Figure 5:
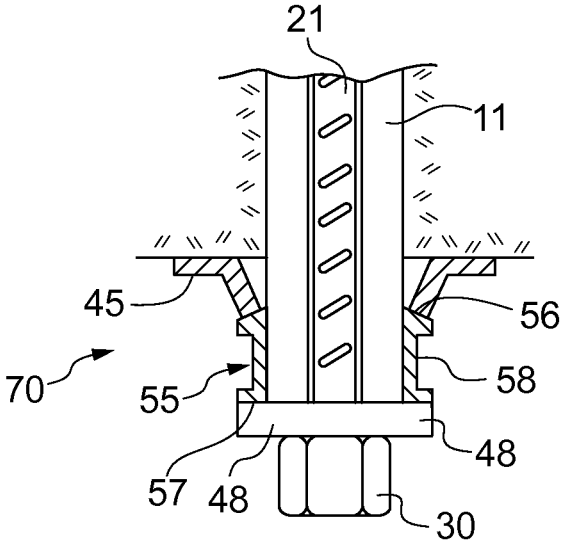
FIG. 5 is a cross-sectional view of the trailing end of a friction rock bolt according to another aspect of the present invention.

A further alternative load absorber is a compressible element and such an arrangement is shown in FIG. 5. In FIG. 5, the same components that have been included in FIG. 1 are given the same reference numerals. Thus, FIG. 5 illustrates a rock bolt tube 11, a bar 21, a nut 30, a rock plate 45 and a washer 48. However, FIG. 5 also illustrates a compressible cylindrical collar 55 which extends axially between the rock plate 45 and the washer 48. The rock plate 45 bears against bearing surface 56 of the collar 55, while the washer 48 bears against bearing surface 57. Between the bearing surfaces 56 and 57 is a neck 58 and it can be seen in FIG. 5, that the outside diameter of the neck 58 is reduced compared to the outside diameters of the collar 55 at the bearing surfaces 56 and 57.

The compressible collar 55 is intended to compress, crush or crumple at a particular load applied to it by the rock plate 45. That load could be the same load that causes the spot welds 50 of the rock bolt 10 to fail or it could be a greater or lower load to cause failure. Regardless, upon the load being sufficient to cause the element 55 to fail, collar 55 will fail by the neck 58 crushing or crumpling. Once the collar 55 has failed to the maximum it can, the load energy that has not already been absorbed by failure of the collar 55 is transferred to the washer 48. Thus, the load energy that is transferred to the washer 48 is reduced compared to the load energy that the collar 55 was exposed to initially. Upon that transfer, the second stage of load support is the same as explained in relation to the rock bolt 10 when the ring 47 shears and engages the washer 48.

Figure 6:
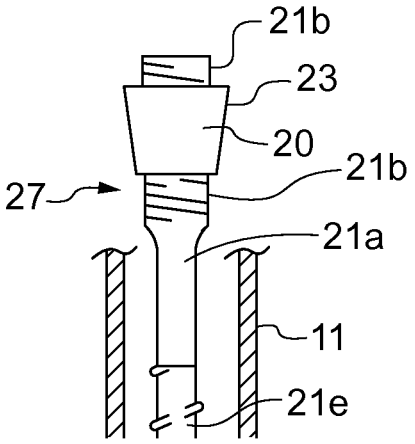
FIG. 6 is a cross sectional view of an axially forward region of friction rock bolt according to a further aspect of the present invention.

FIG. 6 illustrates a further embodiment of the present rock bolt in which elongate bar 21 is radially enlarged at its leading end 27. In particular, bar 21 may be divided axially so as to comprise a main length section 21*e* having external ribs. Bar 21 then transitions to a generally smooth or unribbed region 21*a* A radially enlarged section 21*b* extends axially from section 21*a* and comprises threads, as described with reference to FIGS. 1 and 3 to mount the radially inner element 20 (in a form of a conical wedge). As described, wedge 20 comprises an internal bore having corresponding threads to mate with the threads on radially expanded section 21*b*. Such an arrangement is advantageous to strengthen rod 21 at the leading end 27 against tensile forces imposed on bar 21 during use. Preferably, the threads on end section 21*b* are not typical metric threads and are preferably rounded or rope style threads to minimise the creation of stress concentrations that would otherwise weaken the bar 21 at leading end 27.

Figure 7:
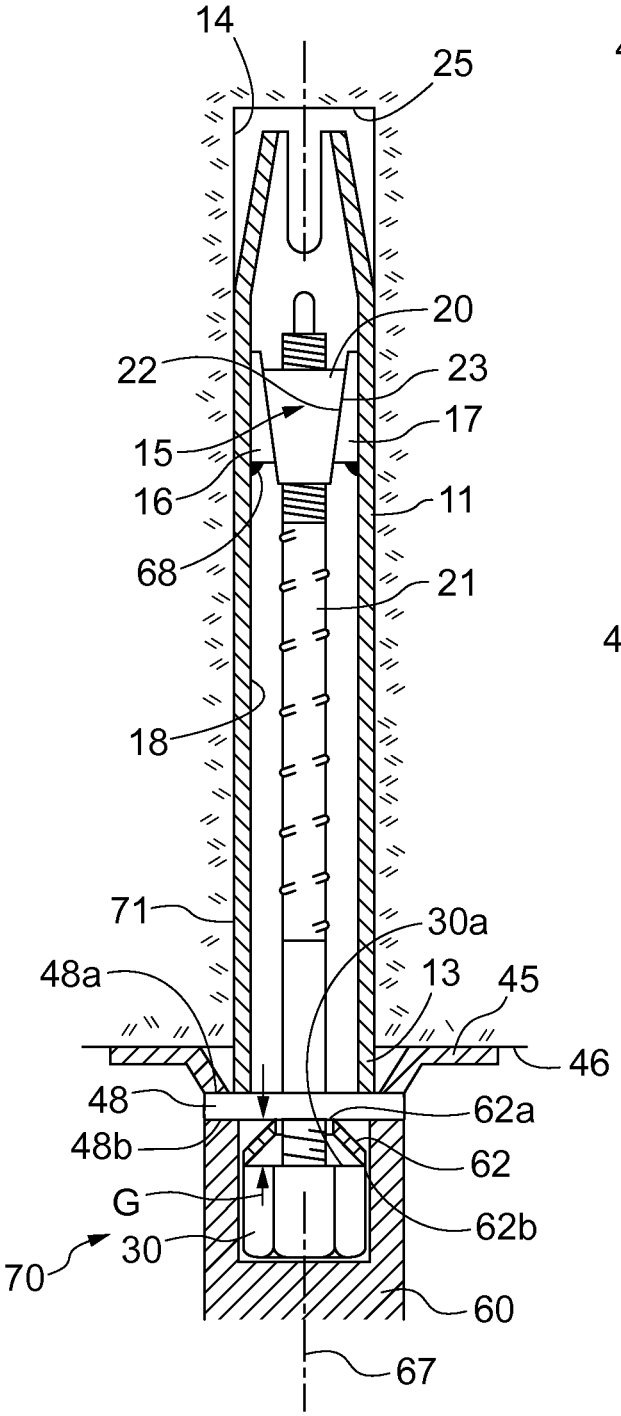
FIG. 7 is a cross sectional view of a friction rock bolt according to a further aspect of the present invention.
Figure 8:
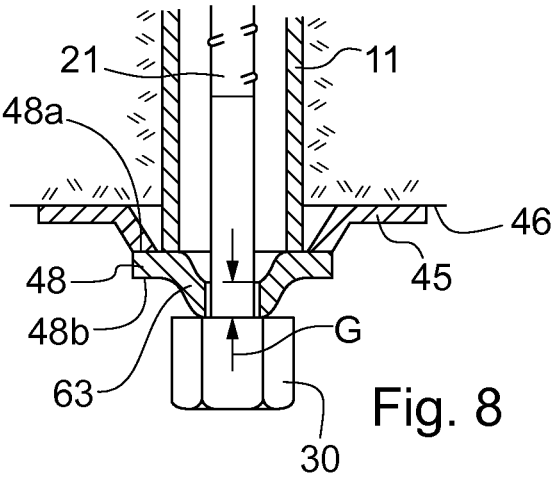
FIG. 8 is a cross sectional view of the trailing end of a friction rock bolt according to a further aspect of the present invention.
Figure 9:
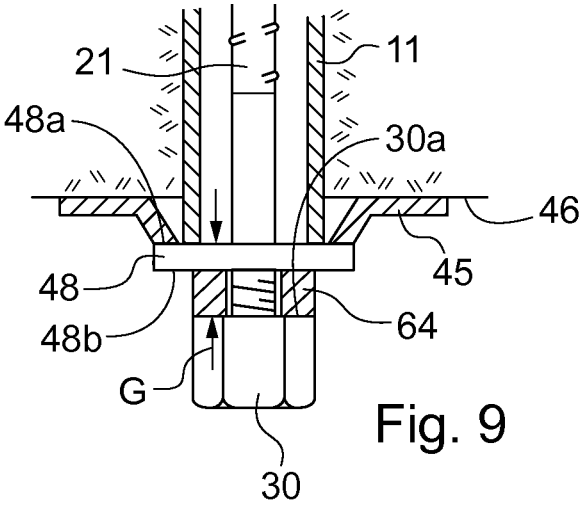
FIG. 9 is a cross sectional view of the trailing end of a friction rock bolt according to a further aspect of the present invention.

FIGS. 7 to 9 illustrate further embodiments of the axially rearward loading mechanism of the present rock bolt. Referring to FIG. 7 and in a further implementation, the loading mechanism, alternatively referred to herein as a load support arrangement, comprises washer 48 positioned axially intermediate rock plate 45 and nut 30. Washer 45 comprises an axially forward facing abutment surface 48*a* that also extends radially outward beyond a radially outward facing external surface 71 of tube 11 at the tube rearward end 13. Abutment surface 48*a* is annular and is configured to engage, in a butting contact, a radially inner region of rock plate 45 such that loading forces imposed on rock plate 45 by the rock face 46 are transmitted into washer 48 that is axially spaced from nut 30 by a gap region G. A conical compressible collar 62 is mounted within the gap region G. Collar 62 comprises an axially forward end 62*a* (in contact with an axially rearward facing face 48*b* of washer 48) and an axially rearward end 62*b* (in contact with an axially forward facing face 30*a* of nut 30).

Collar 62 may be formed from the same material as compressible collar 55 as described referring to FIG. 5 such that collar 62 is capable of compressing via deformation as washer 48 is forced axially rearward by loading forces imposed on rock plate 45 (and hence washer 48) due to movement of the rock surface 46. Collar 62 is dimensioned such that a maximum diameter does not exceed an external diameter of nut 30 such that collar 62 does not extend radially beyond the nut 30. Such an arrangement is advantageous to provide a radially accessible region around nut 30 and collar 62 to receive an axially forward end 60 of a hammer tool used to deliver and force the rock bolt 10 into the bore during initial installation. In particular, the axially forward end of hammer tool 60 is configured for placement in direct contact against the rearward facing surface 48*b* of washer 48 such that the compressive forces delivered to the rock bolt 10 via the tool 60 are transmitted directly through washer 48 and into tube 11 importantly without being transmitted through nut 30 and compressible collar 62. Such an arrangement is advantageous to avoid unintended and undesirable initial compression of collar 62 due to the hammer driven compressive forces by which rock bolt 10 is driven into the borehole. The further embodiments of FIGS. 8 and 9 are also configured for avoiding a compressive force transmission pathway through the load absorber component (in the form of a compressible washer, gasket, seal, flange etc. as described herein). Accordingly, in some embodiments, preferably washer 48 extends radially outward beyond tube 11, nut 30 and the load absorber, so as to present an accessible rearward facing surface 48*b* for contact by the leading end of the hammer tool 60.

A further embodiment of the loading mechanism is described referring to FIG. 8 in which flange 48 comprises corresponding surfaces 48*a*, 48*b*. However, differing from the embodiment of FIG. 7, a radially inner section 63 of washer 48 is dome-shaped so as to curve in the axial direction towards nut 30 (secured at the rearward end of bar 21). Dome section 63 occupies the gap region G between the main body of washer 48 and nut 30. Accordingly, as load from the rock strata surface 46 is transmitted into rock plate 45 and accordingly into washer 48 via surface 48*a*, dome section 63 is configured to compress such that the washer 48 flattens to reduce gap G.

FIG. 9 illustrates a further embodiment of the rock bolt of FIG. 7 in which the conical collar 62 is formed as a generally cylindrical deformable collar 64. As with the embodiment of FIG. 7, collar 64 is dimensioned so as to not extend radially outward beyond nut 30 to provide access to the washer surface 48*b* by the hammer tool 60 and accordingly avoid compressive force transmission through collar 64 during initial hammering of the rock bolt 10 into the borehole as described.

Figure 10:
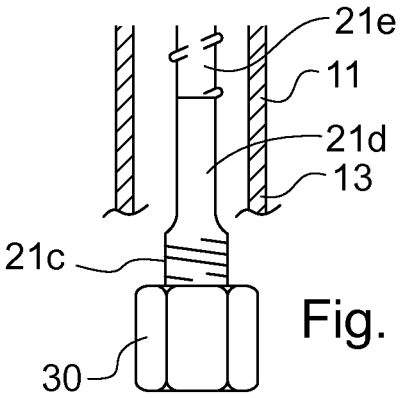
FIG. 10 is a cross sectional view of the trailing end of a friction rock bolt according to a further aspect of the present invention.

FIG. 10 illustrates a further embodiment of the rock bolt 10 corresponding to the arrangement of FIG. 6 having a radially enlarged section of bar 21. As illustrated in FIG. 10, bar 21 at an axially rearward region of main length section 21*e* comprises a non-ribbed generally smooth section 21*d*. A radially enlarged section 21*c* extends from the rearward end of smooth section 21*d* and comprises threads to mate with corresponding threads formed on a radially inward facing surface (not shown) of nut 30 so as to secure nut 32 to bar 21. As described referring to FIG. 6, the enlarged section 21*c* provides reinforcement of the bar 21 against tensile forces encountered during use with the thread configuration at section 21*c* being preferably the same as described at section 21*b*.

The expander mechanism as described herein comprising at least two radially outer expander elements 16, 17, 44 is advantageous to maximise the radial expansion force imposed by the axially rearward movement of the inner wedge element 20. As indicated, in contrast to existing rock bolt configurations having a single outer wedging element, the present configuration provides a greater maximum radial expansion (combined radial movement of wedging elements 16, 17, 44) relative to the corresponding maximum radial displacement achievable by a single outer wedging element.

Additionally, the present arrangement, via the plurality of outer wedging elements 16, 17, 44 provides a desired symmetrical tube expansion. This is achieved, in part, via the circumferential spacing between the wedging elements 16, 17, 44, the provision of a secondary elongate slot 51 and the oblique alignment of the inward and outward facing surfaces of the respective outer and inner wedging elements 16, 17, 44 and 20, 20*a*. The controlled interaction between and parallel alignment of the mating surfaces 22, 23 (of the wedging elements 16, 17, 44, 20, 20*a*) is beneficial to avoid development of sideways (torsional) forces at the region of the expander mechanism 15, 35 that i) would reduce the desired frictional contact, ii) lead to possible development of galling of the wedging elements 16, 17, 44, 20, 20*a* and iii) reduce the performance in the clamping action of the expander mechanism 15, 35. Additionally, and as will be appreciated, the provision of a secondary slot 51 in addition to the primary slot 26 reduces the magnitude of force absorbed by the tube 11 as the expander mechanism 15, 35 is expanded which, in turn, maximises the efficiency and effectiveness of the expansion mechanism 15, 35 to deform tube 11 into tight frictional contact with the surrounding rock strata.

As will be appreciated, the present rock bolt may comprise a plurality of secondary elongate slots 51 with each slot 51 spaced apart in a circumferential direction around the central longitudinal axis 67 of rock bolt 10. Similarly, the present rock bolt 10 may comprise a plurality of outer wedging elements 16, 17, 44 (optionally including 2, 3, 4, 5, 6, 7 or 8 separate elements) each spaced apart in a circumferential direction around axis 67. Preferably, to facilitate radial expansion of tube 11 via the slots 51, wedging elements 16, 17, 44 are secured to tube 11 at locations between the slots 26 and 51 and do not bridge or otherwise obstruct slots 51.

The embodiments illustrated in the figures discussed above are expected advantageously to allow for more reliable and secure rock strata support under loading, such as seismic loading or loading due to ground swelling. Failure of a bar or cable (for example due to the bar or cable being effectively 'pulled-through' the outer wedges) of a rock bolt according to the invention is expected to be less likely while the greater radial expansion provided in a rock bolt according to the invention is expected to provide more secure anchoring of a rock bolt within a bore.

The invention claimed is:

1. A friction bolt assembly arranged to frictionally engage an internal surface of a bore formed in rock strata, the assembly comprising:

an elongate tube having a leading end, a trailing end and a longitudinally extending primary slot;

an expander mechanism located within the tube towards the leading end and configured to apply a radial expansion force to the tube to secure the assembly to the rock strata; and an elongate tendon extending longitudinally within the tube and connected at or towards a first end to the expander mechanism and at or towards a second end to a loading mechanism positioned at or towards the trailing end of the tube that by adjustment is configured to create tension in the tendon to act on the expander mechanism and provide the radial expansion force, the expander mechanism including at least two radially outer wedge elements positionally secured to the tube and a radially inner wedge element secured to the tendon arranged for axial movement relative to the outer wedge elements to apply the radial expansion force to the outer wedge elements, wherein the elongate tube includes at least one secondary slot positioned axially at the expander mechanism and extending beyond the expander mechanism in both the axial forward and rearward directions, the tube being arranged to deform radially at an axial position of the expander mechanism via the primary slot and the at least one secondary slot in response to axial movement of the inner wedge element and the expansion force transmitted by the outer wedge elements.

2. The assembly as claimed in claim 1, wherein the outer wedge elements each have a radially inward facing surface that is oblique relative to a longitudinal axis extending through the assembly and wherein a radially outward facing surface of the inner wedge element extends oblique relative to the longitudinal axis.

3. The assembly as claimed in claim 2, wherein the radially inward facing surface of the outer wedge elements and/or the radially outward facing surface of the inner wedge element are generally planar or are at least part conical.

4. The assembly as claimed in claim 1, wherein the secondary slot is positioned diametrically opposed to the primary slot.

5. The assembly as claimed in claim 1, wherein an axial length of the secondary slot is less than an axial length of the primary slot.

6. The assembly as claimed in claim 5, wherein the axial length of the secondary slot is 0.5 to 40% of a total axial length of the elongate tube.

7. The assembly as claimed in claim 1, wherein the secondary slot has a width being less than a width of the primary slot.

8. The assembly as claimed in claim 1, wherein the outer wedge elements are spaced apart in a circumferential direction by an equal separation distance.

9. The assembly as claimed in claim 1, wherein in a circumferential direction, the outer wedge elements are positioned between and do not overlap with the primary and secondary slots.

10. The assembly as claimed in claim 1, wherein the outer wedge elements are secured to the tube by a weld.

11. The assembly as claimed in claim 1, wherein at least a portion of each of the outer wedge elements extends axially beyond the leading end of the tube.

12. The assembly as claimed in claim 11, wherein a maximum outside diameter of the inner wedge element is greater than an inside diameter of the tube.

13. The assembly as claimed in claim 11, wherein a maximum outside diameter of the inner wedge element is approximately equal to an outside diameter of the tube.

14. The assembly as claimed in claim 1, wherein at least a portion of the radially inner wedge element extends axially beyond the leading end of the tube.

15. The assembly as claimed in claim 1, wherein the tendon is an elongate bar that is radially enlarged at or towards the first end.

16. The assembly as claimed in claim 15, wherein the first end of the bar comprise threads, the threads provided at the radially enlarged first end.

17. The assembly as claimed in claim 16, wherein the inner wedge element is mounted on the bar via the threads.

18. The assembly as claimed in claim 1, comprising a single primary slot, a single secondary slot and two outer wedge elements positioned diametrically opposite one another and spaced apart in a circumferential direction between the primary and secondary slots.

* * * * *